US006761298B1

(12) United States Patent
Cantrell

(10) Patent No.: US 6,761,298 B1
(45) Date of Patent: Jul. 13, 2004

(54) WRAPPING PLASTIC

(76) Inventor: Sandra K. Cantrell, 33 Cove Dr., Wilsonville, AL (US) 35186

( * ) Notice: Subject to any disclaimer, the term of this patent is extended or adjusted under 35 U.S.C. 154(b) by 46 days.

(21) Appl. No.: 10/112,204

(22) Filed: Mar. 29, 2002

(51) Int. Cl.[7] ..... B65H 35/06

(52) U.S. Cl. ..... 225/42; 225/44; 225/89; 242/596.1

(58) Field of Search ..... 225/1, 42, 44, 225/45, 46, 47, 86, 89, 92; 83/649; 242/598.2, 598.3, 598.6, 599.1, 599.3, 423.1, 591, 571, 596.1, 596.6

(56) References Cited

U.S. PATENT DOCUMENTS

| | | | | | |
|---|---|---|---|---|---|
| 846,194 | A | * | 3/1907 | Finan | 225/82 |
| 854,517 | A | * | 5/1907 | McCain | 30/523 |
| 2,093,562 | A | * | 9/1937 | Hope | 225/47 |
| 2,229,961 | A | * | 1/1941 | Deane | 225/19 |
| 4,094,416 | A | * | 6/1978 | Smith | 211/85.28 |
| 4,097,002 | A | * | 6/1978 | Krueger | 242/596.1 |
| 5,082,159 | A | * | 1/1992 | Gutierrez | 225/34 |
| 5,277,351 | A | * | 1/1994 | McCullagh | 225/38 |
| 5,322,234 | A | * | 6/1994 | Robert et al. | 242/596.7 |
| 5,364,042 | A | * | 11/1994 | Wyman | 242/348 |
| 5,810,234 | A | * | 9/1998 | Burli | 225/106 |
| 5,868,345 | A | * | 2/1999 | Beisser | 242/592 |
| 5,878,976 | A | * | 3/1999 | Duck | 242/596.1 |
| 6,367,734 | B1 | * | 4/2002 | Cartwright | 242/599.1 |
| 6,572,051 | B1 | * | 6/2003 | Stude | 242/598.2 |

* cited by examiner

*Primary Examiner*—Boyer D. Ashley

(57) ABSTRACT

A wrapping plastic dispenser configured to dispense wrapping plastic supplied on a roll. The wrapping plastic dispenser is adjustable such that it can accommodate rolls of varying widths. To attain this, the dispenser has two opposed arms between which to mount a roll of wrap. In an embodiment, one arm moves with respect to the other in order to accommodate wider rolls of wrap. The wrapping plastic is particularly suited to dispense plastic with which to wrap gifts. To attain this, the wrapping plastic may be opaque or may be self-sealing through either static or pressure adhesive.

7 Claims, 3 Drawing Sheets

WRAPPING PLASTIC

BACKGROUND OF THE INVENTION

1. Field of the Invention

The present invention relates to wrapping plastic and a holder therefore. The wrapping plastic and holder has particular utility in connection with wrapping gifts.

2. Description of the Related Art

Wrapping paper for the purpose of wrapping gifts is known in the prior art. Such wrapping paper is customarily produced and sold in rolls comprising sheets of decorated wrapping paper wound on disposable, hollow, cylindrical, heavy paper or cardboard tubes. Wrapping paper comes in rolls of varying lengths and widths, thus accommodating gifts of a variety of sizes and shapes. Wrapping gifts with wrapping paper requires additional materials, e.g., scissors to cut the wrapping paper and tape to fasten the wrapping paper closed. Further, an amount of skill is required to wrap the gift such that the gift remains obscured from view. For example, the paper may tear. This may be particularly so if the gift is odd shaped and/or not held within a box. As another example, the paper may not be completely opaque, allowing one to see through the paper.

Transparent plastic film for the purpose of covering food is known in the prior art. However, such plastic film comes on a roll of a standard size, thus a dispenser for said film would not be adjustable to accommodate rolls of varying sizes. Further, transparent plastic film could not be used to wrap a gift such that the gift remains obscured from view.

Plastic wrap dispensers are known in the prior art. For example, U.S. Pat. No. 5,186,376 to Scharf et al. discloses a dispenser having a housing consisting of a cover unit and a base unit. However, Scharf '376 does not disclose an adjustable lever for expanding the size of the dispenser such that it is adjustable to accommodate plastic wrap rolls of varying sizes, nor does Scharf '376 disclose a cutting device associated therewith. Further, Scharf '376does not disclose an opaque plastic wrap.

Similarly, U.S. Pat. No. 5,673,542 to Vartanian et al. discloses an apparatus for wrapping variously sized articles. However, Vartanian et al. '542 does not disclose an adjustable lever for expanding the size of the dispenser such that it is adjustable to accommodate plastic wrap rolls of varying sizes, nor does Vartanian et al. '542 disclose a cutting device associated therewith. Further, Vartanian et al. '542 does not disclose an opaque plastic wrap.

Likewise, U.S. Pat. No. 5,007,319 to Armbruster discloses a plastic wrap dispenser, but Armbruster '319 does not disclose an adjustable lever for expanding the size of the dispenser such that it is adjustable to accommodate plastic wrap rolls of varying sizes, nor does Armbruster '319 disclose a cutting device associated therewith. Further, Armbruster '319 does not disclose an opaque plastic wrap.

Also, U.S. Pat. No. 5,768,968 to Park et al. discloses a plastic film food wrap dispenser, but Park '968 does not disclose an adjustable lever for expanding the size of the dispenser such that it is adjustable to accommodate plastic wrap rolls of varying sizes, nor does Park '968 disclose a cutting device associated therewith. Further, Park '968 does not disclose an opaque plastic wrap.

U.S. Pat. No. 6,195,961 to Turfan discloses a stretch film roll mounting frame, yet the frame disclosed by Turfan '961 does not disclose an adjustable lever for expanding the size of the dispenser such that it is adjustable to accommodate plastic wrap rolls of varying sizes, nor does Turfan '961 disclose an adjustable cutting device associated therewith. Further, Turfan '961 does not disclose an opaque plastic wrap.

Lastly, U.S. Des. Pat. No. 357,377 to Manu et al. discloses a plastic film food wrap dispenser, yet the dispenser disclosed by Manu '377 does not appear to be adjustable to accommodate plastic film food wrap rolls of varying sizes, nor does Manu '377 appear to disclose a cutting device associated therewith. Further, Manu '377 cannot disclose an opaque plastic wrap.

While the above-described devices fulfill their respective, particular objectives and requirements, the aforementioned patents do not describe an opaque wrapping plastic or a dispenser therefore. Moreover, the above-mentioned patents make no provision for allowing dispense of wrapping plastic of varying widths. Furthermore, the above-mentioned patents do not satisfy the additional limitations of the prior art set forth above.

Therefore, a need exists for a new and improved wrapping plastic that would allow the wrapping of gifts without the use of scissors or tape. A need exists for a wrapping plastic dispenser that would accommodate and cut wrapping plastic rolls of varying widths. Further, a need exists for an opaque wrapping plastic.

In this regard, the present invention substantially fulfills these needs. In this respect, the wrapping plastic and wrapping plastic dispenser according to the present invention substantially departs from the conventional concepts and designs of the prior art, and in doing so provides an apparatus primarily developed for the purpose of dispensing wrapping plastic to wrap gifts.

SUMMARY OF THE INVENTION

In view of the foregoing disadvantages inherent in the known types of wrapping plastic dispensers now present in the prior art, the present invention provides an improved wrapping plastic dispenser, and overcomes the above-mentioned disadvantages and drawbacks of the prior art. As such, the general purpose of the present invention, which will be described subsequently in greater detail, is to provide a new and improved wrapping plastic dispenser which has all the advantages of the prior art mentioned heretofore and many novel features that result in a wrapping plastic dispenser which is not anticipated, rendered obvious, suggested, or even implied by the prior art, either alone or in any combination thereof.

To attain this, the present invention essentially comprises a wrapping plastic dispenser that is adjustable to accommodate rolls of wrapping plastic of varying length. To attain this, the wrapping plastic dispenser has a base and two laterally opposed arms. One arm is rigidly mounted onto the base, and the other arm is mounted onto the base in such a way as to allow the distance between the arms to be adjusted, thus accommodating rolls of wrapping plastic of varying widths. In an embodiment, the wrapping plastic dispenser includes a base back, a base arm, an end back and an end arm, where the base back and base arm remain stationary relative to one another, and where the end back and end arm remain stationary relative to one another, and where the base back and end back may be moved relative to one another. In an embodiment, the wrapping plastic dispenser includes an adjustment lever, where the adjustment lever has an open position in which the end arm is moveable, and a close position in which the end arm remains stationary. In an embodiment, the wrapping plastic dispenser includes a cutting means by which to cut the wrapping plastic to a desired length. In an embodiment, a wrapping plastic dispenser is adjustable and a wrapping plastic is opaque.

There has thus been outlined, rather broadly, some of the more important features of the invention in order that the detailed description thereof that follows may be better understood and in order that the present contribution to the art may be better appreciated.

The invention may also be mounted to a stationary object, such as, for example, a wall. Alternately, the invention may be freestanding. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wrapping plastic dispenser that has all of the advantages of the prior art wrapping plastic dispenser and none of the disadvantages.

It is another object of the present invention to provide a new and improved wrapping plastic dispenser that may be easily and efficiently manufactured and marketed.

An even further object of the present invention is to provide a new and improved wrapping plastic dispenser that has a low cost of manufacture with regard to both materials and labor, and which accordingly is then susceptible of low prices of sale to the consuming public, thereby making such wrapping plastic dispenser economically available to the buying public.

Still another object of the present invention is to provide a new wrapping plastic dispenser that provides in the apparatuses and methods of the prior art some of the advantages thereof, while simultaneously overcoming some of the disadvantages normally associated therewith.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

Figure 1:
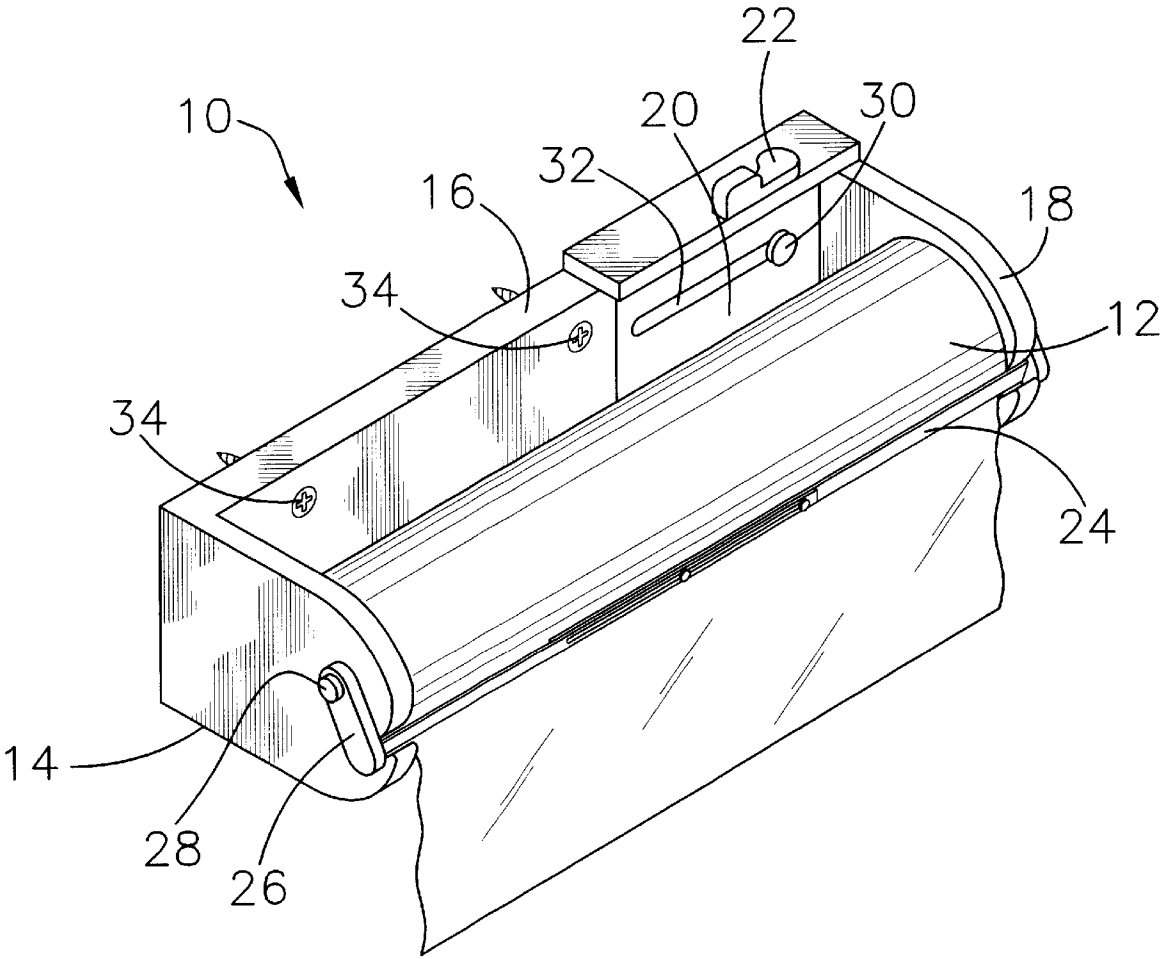
FIG. 1 is an oblique view of an embodiment of the wrapping plastic holder including a roll of wrapping plastic.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Referring now to the drawings, and particularly to FIGS. 1–4, preferred embodiments of the wrapping plastic dispenser of the present invention are shown and generally designated by the reference numeral 10.

In FIG. 1, a new and improved wrapping plastic dispenser 10 is illustrated and will be described as follows. More particularly, wrapping plastic dispenser 10 is comprised of a base back 16 to which is rigidly mounted or affixed a base arm 14. Coupled to base back 16 is end back 20 to which is rigidly mounted end arm 18. Base back 16 and end back 20 are coupled together in such a fashion as to allow one to move relative to the other. For example, end back 20 may be somewhat hollow thus allowing a changeable portion of base back 16 to be arranged within end back 20. In this manner, the distance between base arm 14 and end arm 18 may vary. Base back 16 and base arm 14 may be wood, plastic, pressboard, metal, or any suitable rigid material. Similarly, end back 20 and end arm 18 may be any suitable rigid material, and this material may or may not be the same material as used for base back 16 and base arm 14. Base back 16 and base arm 14 may be of the same material, as, for example, a molded plastic, or base back 16 and base arm 14 may be of differing materials and the two component pieces fashioned together to create an integral whole. The same is true of end arm 18 and end back 20.

End arm 18 and base arm 14 are configured to receive and hold between them a roll of wrapping film or plastic. End arm 18 and base arm 14 are shown as substantially parallel to one another, but they are not necessarily parallel. Base arm 14 and end arm 18 may be of any shape or configuration such that allows holding between them a roll of wrapping film. Coupled to each arm is cutting arm mounting means 28. Cutting arm mounting means 28 may be bolts or screws, or any suitable fastener that holds a cutting arm 26 on each of base arm 14 and end arm 18. Cutting arm mounting means 28 thus couples cutting arm 26 to the arms upon which the wrapping film is mounted. However, cutting arm 26 is coupled in such a fashion as to allow movement. For example, cutting arm 26 pivots about an axis through cutting arm mounting means 28. Held by cutting arm 26 is an adjustable cutting means 24. Cutting means 24 may be, for example, a metal blade that telescopes such that the length of the cutting blade is commensurate with the width of the wrapping film. Cutting means 24 may be any suitable material that may cut wrapping film.

Base back 16 and end back 20 are shown as substantially perpendicular to base arm 14 and end arm 18, respectively. The back portions 16 and 20 of the wrapping plastic dispenser 10 are not necessarily perpendicular to the arms 14 and 18. The back portions 16 and 20 may be of any shape or configuration such that allows them to move relative to one another to accommodate rolls of wrapping film where the rolls may vary in width. In an embodiment, the end arm 18 may be moved such that the distance between the end arm and the base arm is increased by as much as 100 percent. In an alternate embodiment, end arm 18 and base arm 14 may be moved such that the distance between them increases by much more than 100 percent. In such an embodiment, end arm and base arm may be tethered together by, for example, a spring to allow the distance between the arms to be increased greatly, yet maintain some type of coupling between the arms.

Figure 2:
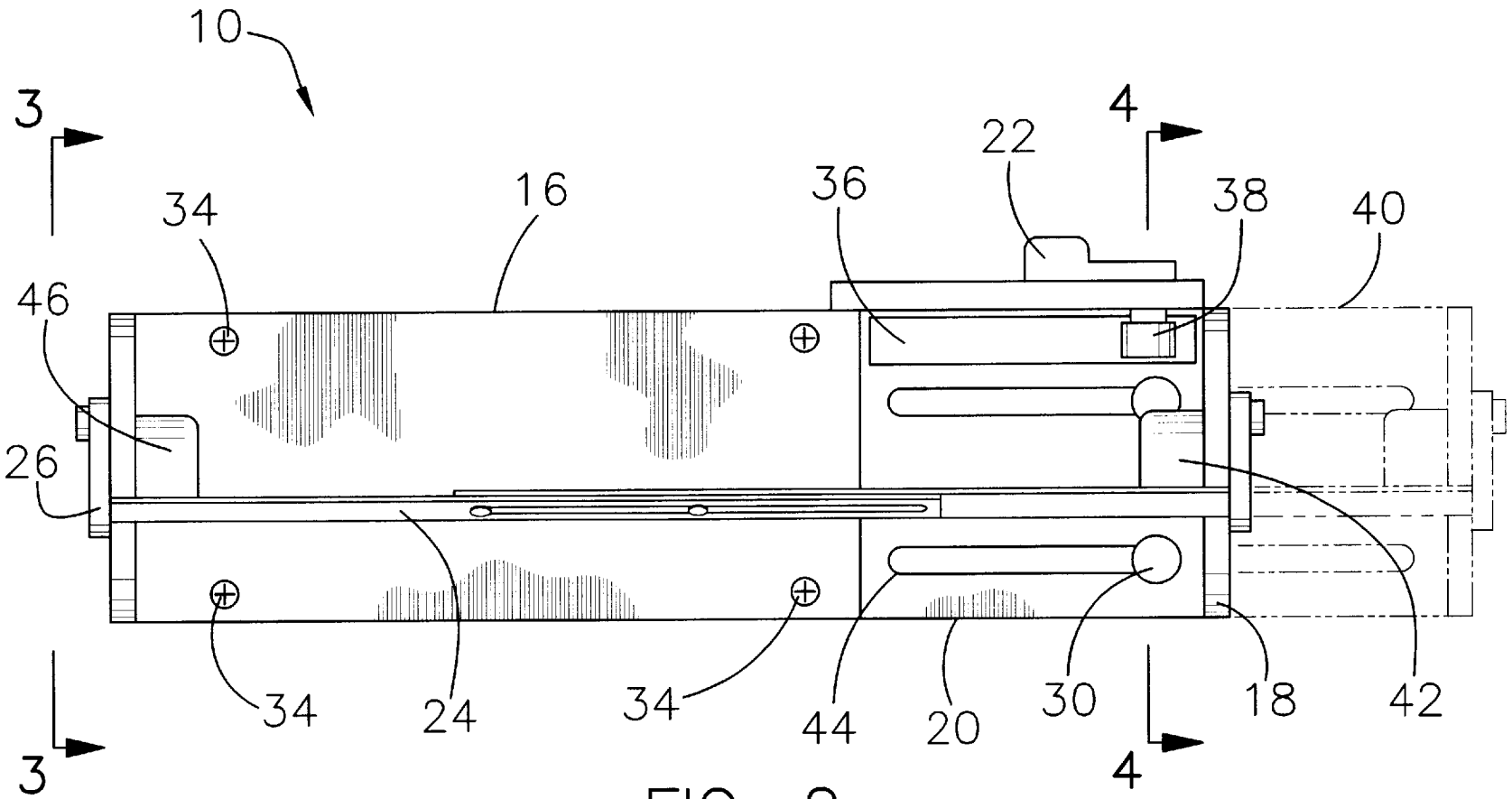
FIG. 2 is a side view of an embodiment of the wrapping plastic holder of the present invention.

In a preferred embodiment, end arm 18 may move relative to base arm 14, but end arm 18 may also remain stationary with respect to base arm 14. Adjusting lever 22 may be opened to allow end arm 18 to move, or it may be may closed thus holding end arm 18 stationary with respect to base arm 14. Lever 22 may be of any suitable rigid material such as, but not limited to, metal, wood, plastic, glass, or the like. Referring to FIG. 2, adjusting lever 22 may be pulled to an "open" position by rotating the lever 22 counterclockwise about the axis shown by the line 4. The "open" position allows the movement of back 20 and end arm 18, collectively referred to herein as end piece 40. End piece 40 may be moved with respect to base back 16 when lever 22 is in the open position. End piece 40 may be adjusted the full length of end slot 44. That is, in an embodiment, the additional distance that end arm 18 may be moved away from base arm 14 is equivalent to the length of end slot 44. In an embodiment, end slots 44 are machined through the end back 20. Through each end slot 44 is arranged a base post 30. Base post 30 is fixably coupled to base back 16. As shown, two base posts 30 are employed. However, one base post 30 may suffice for some embodiments. Further, more than two base posts may be utilized for some embodiments.

In use, the lever 22 could be rotated to an open position, and one end of a roll of wrapping film 12 could be placed onto base roll post 46. End piece 40 then could be moved such that the other end of the roll of wrapping film 12 could be arranged upon end roll post 42. The end piece 40 could then be moved into a position such that the roll of wrapping film 12 would be held between base arm 14 and end arm 18. Lever 22 could then be rotated counter-clockwise into a closed position. In an embodiment, such counter-clockwise rotation would engage a lever extension 38 with a contact area 36, thus preventing the movement of end piece 40. Lever extension 38 could be from any of a group of compressible material such as cotton wadding, natural fiber, synthetic fiber, rubber, or plastic. Further, lever extension 38 could be of the same rigid material as lever 22. In an embodiment, contact area 36 could preferably be of a compressible material. However, in an embodiment, contact are 36 could be of the same material as that which end piece 40 is constructed.

Figure 4:
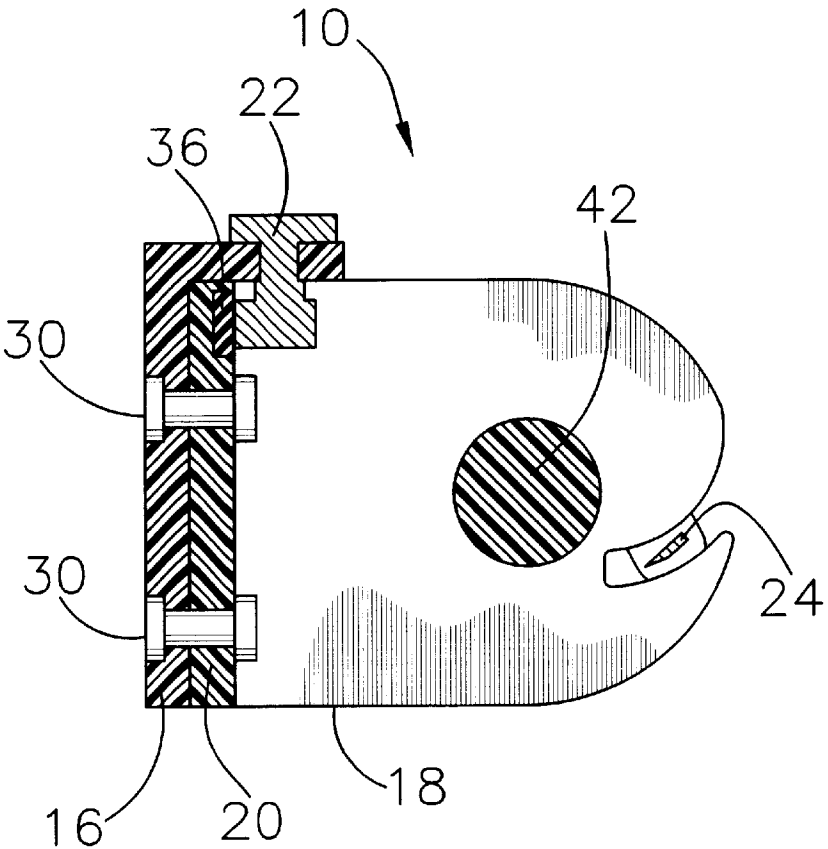
FIG. 4 is a cross-section view of an embodiment of the wrapping plastic holder of the present invention. The cross-section is taken on line 4 of FIG. 2.
Figure 3:
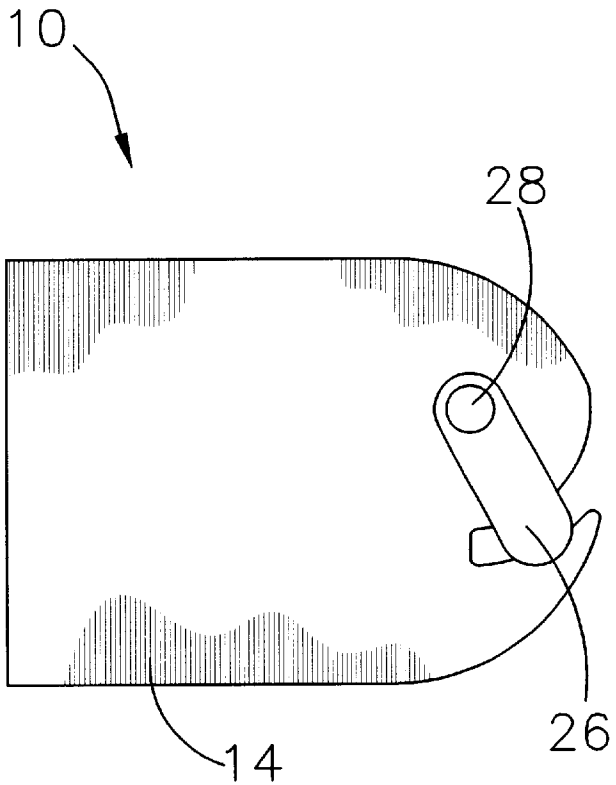
FIG. 3 is an end view of an embodiment of the wrapping plastic holder of the present invention. The end view is taken on line 3 of FIG. 2.

In an embodiment, it may be necessary to rotate cutting arm 26 counterclockwise to accommodate the roll of wrapping film 12 in order to place the roll into the dispenser. The placement of the cutting arm 26 with respect to the base arm 14 is shown in FIG. 3. In an embodiment, cutting means 24 is accommodated within a slot in end arm 18 as shown in FIG. 4. In use, the wrapping plastic would be pulled down from its roll to a desired length and then pulled up and out against cutting means 24 in order to be cut to the desired length. In an embodiment, the wrapping plastic would then be wrapped around a gift. The wrapping plastic would be opaque such that the gift could not be viewed once wrapped. Further, the wrapping plastic could stay closed without the use of tape. This could be accomplished either due to static charge or due to the inside of the wrapping plastic having a light adhesive. For example, the wrapping plastic could have a pressure sensitive adhesive incorporated therewith.

The wrapping plastics may have a wide variety of colors and designs. For example, the wrapping plastic could have a design for holidays such as birthdays, Christmas, Hanukkah, Kwanzaa, Mother's Day, Father's Day, Valentine's Day, Easter, Graduation, Anniversaries, Weddings, or Showers. The wrapping plastic could be in any conceivable color. Further, wrapping plastics may be provided in a wide variety of roll widths such that a wide variety of gifts could be accommodated. Consequently, wrapping plastic dispensers may come in multiple sizes to accommodate the many types and sizes of wrapping plastic or wrapping film. For example, the wrapping plastic may have a width as small as approximately six inches or as large as approximately four feet.

In use, it can now be understood that the wrapping plastic dispenser described herein would provide an improved wrapping plastic dispenser. While some preferred embodiments of the wrapping plastic dispenser have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable rigid material may be used for the wrapping plastic dispenser instead of the plastic construction described. Also, the lever could be replaced with an alternate assembly that could alternately allow and restrict movement of the end arm. And although a wall mounted dispenser is described, it should be appreciated that the dispenser herein described may also be adapted to be counter top mounted. Furthermore, a wide variety of components and materials may be used to fulfill the functions of the described components. The wrapping plastic dispenser may be constructed of metal, plastic, composite, polymer, wood, or any suitable rigid material. Still further, the wrapping plastic dispenser may be configured to be free standing, requiring no base mounting means.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparatus for dispensing wrapping plastic, comprising:

a base arm mounted onto a base back such that the base arm remains stationary with respect to the base back, wherein the base arm is a first in a pair of laterally opposed arms, and wherein the pair of laterally opposed arms is adapted to receive wrapping plastic;

an end arm, wherein the end arm is a second in the pair of laterally opposed arms, wherein the end arm is mounted onto an end back, wherein the end back is movable with respect to the base back, and wherein the end arm is movable with respect to the base arm;

an adjustment lever, wherein the adjustment lever has an open position in which the end arm is movable, and wherein the adjustment lever has a closed position in which the end arm is fixed, wherein the apparatus is configured to receive a roll of wrapping plastic, and wherein the apparatus adjusts to accommodate the width of the roll of wrapping plastic and an adjustable cutting means.

2. The apparatus as recited in claim 1, further comprising an adjustable cutting means.

3. The apparatus as recited in claim 1, wherein the adjustable cutting means is mounted to a cutting arm.

4. The apparatus as recited in claim 3, further comprising cutting arm mounting means to operably couple the cutting arm to each the base arm and the end arm.

5. The apparatus as recited in claim 1, further comprising at least one base post, wherein the base post is integral with the base back.

6. The apparatus as recited in claim 5, further comprising at least one slot through the base end, wherein each base post occupies a corresponding slot, and wherein the length of the slot corresponds to the distance the base end may be moved with respect to the base back.

7. The apparatus as recited in claim 1, further comprising mounting means coupled to the base back.

* * * * *